US006002894A

United States Patent [19]

De Niel et al.

[11] Patent Number: 6,002,894

[45] Date of Patent: Dec. 14, 1999

[54] SINGLE-PASS FUSING OF SHEET-FED MULTI-LAYER DUPLEX COPIES

[75] Inventors: Marc De Niel, Hove; Serge Tavernier, Lint; Luc Van Aken, Kuringen; Luc Van Goethem, Sint-Gillis-Waas, all of Belgium

[73] Assignee: Agfa-Gevaert, Mortsel, Germany

[21] Appl. No.: 09/039,845

[22] Filed: Mar. 16, 1998

[30] Foreign Application Priority Data

Mar. 14, 1997 [EP] European Pat. Off. ..... 97200780

[51] Int. Cl.[6] ..... G03G 15/20

[52] U.S. Cl. ..... 399/69; 219/216; 219/469; 399/328; 399/330; 399/333

[58] Field of Search ..... 399/325, 327, 399/328, 330, 333, 335, 337, 336, 338, 69, 67; 219/216, 469, 470

[56] References Cited

U.S. PATENT DOCUMENTS

| | | | |
|---|---|---|---|
| 3,330,189 | 7/1967 | Vil | 95/1.7 |
| 3,936,171 | 2/1976 | Brooke | 355/3 |
| 4,427,285 | 1/1984 | Stange | 355/3 |
| 4,429,990 | 2/1984 | Tamary | 399/325 |
| 4,639,405 | 1/1987 | Franke | 430/124 |
| 4,813,868 | 3/1989 | Soga | 432/8 |
| 5,157,445 | 10/1992 | Shoji et al. | 399/325 |
| 5,177,552 | 1/1993 | Isogai et al. | 399/330 |
| 5,289,245 | 2/1994 | Menjo | 399/324 |
| 5,463,457 | 10/1995 | Takeuchi et al. | 399/85 |
| 5,479,248 | 12/1995 | Yamaguchi et al. | 399/335 |
| 5,481,349 | 1/1996 | Satoh et al. | 399/328 |
| 5,508,797 | 4/1996 | Tonai et al. | 355/285 |
| 5,563,695 | 10/1996 | Sakurai et al. | 399/327 |
| 5,678,153 | 10/1997 | Okamoto et al. | 399/327 |

FOREIGN PATENT DOCUMENTS

| | | |
|---|---|---|
| 0435516 | 7/1991 | European Pat. Off. . |
| 0486723 | 5/1992 | European Pat. Off. . |
| 2102870 | 8/1972 | Germany . |
| 2197619 | 5/1988 | United Kingdom . |

OTHER PUBLICATIONS

Patent Abstracts of Japan, vol. 15, No. 430(P–1270), Pub. No. 03–177874, Aug. 1991.

IBM Technical Disclosure Bulletin "Minimizing Hot Roll fuser Elastomer Wear with Dual Hot Rolls" vol. 33, No. 4, Sep. 1990; pp. 71–73.

*Primary Examiner*—Matthew S. SMith

*Attorney, Agent, or Firm*—Baker & Botts, L.L.P.

[57] ABSTRACT

A fusing station (25) of an electrographic apparatus fixes in a single pass a duplex resinous powder color image (8, 18) to a support material in sheet-form (9) as the sheet is moved over a predetermined path (7). The station comprises two heated fixing rollers (1, 11), rotating in contact with each other, driving means to rotate the fixing rollers, pressing means for applying a meshing force between the fixing rollers, heating sources (4, 14) which have substantially identical characteristics. Both fixing rollers comprise a heat conducting core (3, 13) and a resilient covering (2, 12) which by the pressure between both rollers forms a heating nip. A symmetrical fixing operation on both sides of the sheet is provided. Hereto, the fixing rollers have a substantially identical construction, are positioned symmetrically to the path of the sheet and rotate synchronously to the advancement of the sheet.

16 Claims, 2 Drawing Sheets

SINGLE-PASS FUSING OF SHEET-FED MULTI-LAYER DUPLEX COPIES

FIELD OF THE INVENTION

This invention relates to a fixing-system to be used within an electrographic copying or printing apparatus capable of fusing, in a single pass, toner material to both sides of a support member. More in particular, it relates to a heat and pressure fusing of electrographic multi-layer images on sheets.

BACKGROUND OF THE INVENTION

In a first kind of electrographic printing, particularly in the process of electrophotography, a light image of an original document to be copied or printed is recorded in the form of a latent electrostatic image on a photosensitive member. The generated electrostatic latent image is subsequently rendered visible by application of electroscopic particles, commonly called toner. The toner particles preferably have a definite electric charge sign and as such are attracted by the electrostatic charge pattern of opposite charge sign in proportion to the field strength of the respective areas defining the pattern.

The toner particles forming the visual image are then transferred from the photosensitive member to a support member or receptor support, such as a sheet of plain paper or a plastic film, further shortly indicated as "sheet". Since the toner image is then in a loose powdered form which may be easily disturbed or destroyed, it has to be permanently fixed or fused on said sheet in a fusing or fixing device.

In a second kind of electrographic printing, particularly in Direct Electrostatic Printing (DEP), electrostatic printing is performed directly from a toner delivery means, e.g. a magnetic brush assembly, on a receiving member substrate, called "sheet", by means of an electronically addressable printhead structure. Herein, the toner is deposited directly in an imagewise way on said sheet without occurrence of any latent electrostatic image. An overall applied propulsion field between the toner delivery means and a receiving member support projects charged toner particles through a row of apertures of the printhead structure. The intensity of the toner-stream is modulated according to the pattern of potentials applied to the control electrodes. The deposition step is followed by a fusing step.

As a DEP device has already been described, e.g. in U.S. Pat. No. 3,689,935 (Pressman) and in EP-A-0 710 898 (Agfa-Gevaert N.V.), no further description is necessary in the present application.

In order to permanently fix a toner image to a sheet, it is well known in the art to apply thermal energy. By elevating the temperature of the toner material to a point at which the constituents of the toner coalesce and become tacky or melt, the toner is absorbed into the fibres of the sheet or fixed to the substrate. As thereafter the toner cools, solidification causes it to be firmly bonded to the sheet.

Several approaches to thermal fusing of electroscopic toner images are known from the prior art. Special attention has to be focused on the production of duplex or recto/verso copies or prints, i.e. copies where images are formed on both sides of the sheet.

The production of duplex or recto/verso copies poses problems due to a severely occurring offset problem, which will be discussed in great detail on the next pages.

Duplex printing in electrographic systems, e.g. in electrophotographic copiers, working according to the two pass method may be carried out in one of the following ways.

(i) A so-called "manual two pass method" that requires manual re-feeding of multi-layer imaged simplex sheets, e.g. colour imaged simplex sheets. That is, after the first side of a sheet is imaged and fused, the sheet is transported to an output tray. Then, the operator places this sheet back in one of the input trays, upon which the sheet is again passed through the engine. This time an image is transferred and fused onto the opposite side of each sheet having an image on a first side.

(ii) A so-called "automated postponed two pass method", that requires the collection of simplex sheets in a duplex tray. That is, after the first side of a sheet is imaged and fused, the sheet is transported to a duplex tray inside the engine. After the last sheet in a set has been received in this duplex tray, all sheets are again passed automatically through the imaging device. This time an image is transferred and fused onto the opposite side of each sheet having an image on a first side.

(iii) A so-called "automated immediate two pass method" that requires reversing the simplex sheets immediately after fusing and interleaving them with sheets receiving the first image on the first side in order to receive an image on the opposite side.

These two-pass duplex methods have some very important drawbacks, usually related to the twofold passing through the fuser.

(i) Two passes through the fuser require more energy than one pass. This is especially important for the case of multi-layer imaging, e.g. colour imaging, with its high energy requirement for thorough fusing and mixing of the respective layers or colours.

(ii) At the same time the fuser needs to operate at twice the speed of the duplex throughput, which again in the case of multi-layer or colour fusing is not at all straightforward.

(iii) The change in moisture content (say about 30%) between the first and the second imaging pass results in an image quality that is not equal between the first side imaging and the duplex side imaging.

(iv) In addition, this change in moisture content also alters the mechanical properties of the paper, which—combined with the additional complexity of a duplex paper path—results in a highly increased risk for jams in duplex printing.

(v) Because of the need for a release agent (e.g. silicon oil) in hot roller fusing, silicon oil remaining from the first pass colour imaging may contaminate the image forming elements, resulting again in non constant image quality over time, with possible effects such as image smearing etc.

(vi) Excessive paper curl is not only troublesome in the processor but also extremely difficult to handle in output stackers and finishing devices.

In other prior art systems, also single pass duplex copying has been disclosed. Three methods are known in the art.

(i) According to a first method, first and second images are formed sequentially on a photoreceptor. The first image is transferred from the photoreceptor to the first side of a receptor sheet. Then the sheet is stripped off the photoreceptor, inverted while the first image remains unfixed, and then the second image is transferred to the second side of the receptor sheet. Both images are then fixed onto the receptor sheet in a suitable fuser.

(ii) Other single pass duplex printing methods use intermediate image carriers, e.g. a belt or a drum. The first and second images are sequentially formed on a photoreceptor. The first image is transferred to an intermediate image carrier. The receptor sheet is then passed between the photoreceptor and the intermediate image carrier. The receptor sheet is then simultaneously receiving first and second images.

(iii) Other systems deal with "single pass duplex" methods employing two photoreceptors and two exposure systems. A first image is deposited on one photoreceptor and a second image is deposited on the other photoreceptor. These systems are considered the ultimate duplex throughput systems since they produce twice the number of images of "two pass duplex" systems at equal process speed.

Many problems exist with the traditional single pass duplex systems.

(i) One problem is in conveying the duplex receptor sheet to the fuser. In particular, the receptor sheet with the two unfused images on opposite sides, must be transported from the toner transfer station to the fuser. Preferably this is not done with a conventional transport since the transport would make contact with one of the sides of the receptor sheet and smear the unfused toner image. Also, to avoid the leading edge of the sheet from downwards deviating from the path between transfer station and fuser station, it is preferred that this path is very short. Thereto, the fuser must be very close to the photoreceptor. This creates problems in mechanical mounting, problems due to unwanted heating the photoreceptor and problems of contaminating the photoreceptor with fuser release materials, e.g. silicone oil vapour.

(ii) In addition there is the problem of the rather uncontrollable velocities of sheets passing through roller fusers. There seems to be an obvious need to accurately match the velocity of the receptor sheet transport with the velocity of the photoreceptor to prevent "skips" and "smears" during transfer. Furthermore, for high resolution digital printing, excessive instantaneous photoreceptor velocity variations (cfr. "jitter") cannot be tolerated. Even in conventional copiers it is preferable to keep the fuser rollers one sheet length away from the transfer zone. For these reasons it is desirable to thermally insulate and mechanically isolate the photoreceptor transfer zones from the hot fuser rollers.

(iii) Single pass duplex systems using more than one photoreceptor and more than one exposure system, generally require web paper feed in which the copy is wound up on a roller or cut into individual sheets after fusing. This, unfortunately, introduces additional components and complexity into the system. It is, therefore, also desirable to provide a single pass duplex system having a discrete receptor sheet feed system rather than a web paper feed system.

(iv) Moreover, in high quality copying and printing it has to be made sure that both sides of the duplex imaged sheets experience substantially the same "fusing history", referring namely to the temperature and pressure trajectory.

Multi-layer electrographic printing, e.g. multi-colour electrophotographic printing, may seem equivalent to multiple monochrome (commonly black and white) printing of various toner layers. Yet, successive part images have to be recorded in superposition. These successive part images may comprise a superposition of different toner separation images. In one embodiment, the traditional colour components cyan C, magenta M and yellow Y, are augmented with at least one extra colour component according to one toner type. This extra colour component may have another density or colouring power (obtained by a different degree of pigmentation) of either cyan, magenta or yellow. In another embodiment, a traditional black component K is added to the three usual colour components. In another embodiment, for each traditional colour component, CMY or CMYK, at least a second colour component, having a lower pigmentation level, C'M'Y'(K') is added. According to another embodiment, some tone levels of the original image are reproduced by applying two different toners, having substantially the same chromaticity, or more specifically by applying two achromatic toners, i.e. greyish or black toners of which the chromaticity is substantially zero.

In one embodiment each single toner image is transferred to the receptor sheet in superimposed registration, thereby creating a multi-layered toner image on the receptor sheet. Thereafter, the multi-layered toner image is permanently fixed to the receptor sheet creating a multi-layer or colour copy or print. Whereas the fixing of monochrome toner images does not raise major problems in practice, the fixing of multi-layer or colour images is much more difficult. We will base the discussion on colour images, which are a specific case of multi-layer images.

(i) As a colour toner image intrinsically is thicker than a monochrome toner image, for a same print-quality and a same print-throughput, the supply of fusing heat has to be increased and even controlled more stringently.

(ii) The increased amount of toner requires a longer fusing time demanding a nip with a larger length or a slower rotation of the fuser rollers. It may be remarked that the nip between both rollers, more exactly between the resilient coverings of these rollers, is in fact the area where heat and pressure initiate the fusing and thus the fixing of the toner image on a sheet conveyed between the rollers.

(iii) The fixing of multi-layer images is also difficult as compared to the prior art of fixing single layer images, in that it needs a strongly different geometry of the fixing rollers, calling for a dedicated design of the kind and the geometry, e.g. thickness of the resilient layer on each roller, the diameter of the rollers, the pressure applied to the rollers, etc.

In view of the many problems described, a very interesting application comprises U.S. Pat. No. 4,427,285. However, some drawbacks still pose severe restrictions to the effective use of said patent.

A first restriction of the solution disclosed in U.S. Pat. No. 4,427,285 is that it is not intended for and hardly can be applied for fusing multi-layer toner images.

A second and important restriction of U.S. Pat. No. 4,427,285 is that its solution needs heat isolation means between the fusing station and the photoreceptor.

Hereto, it discloses e.g. a transport mechanism for conveying a receptor sheet having toner images on both sides, towards the heat source for fusing, thereby thermally isolating the photoreceptor from the heat source.

U.S. Pat. No. 4,427,285 also discloses a heat shield disposed between a transfer station and a heat applying device, thereby carrying out two distinct functions, namely (i) isolating the heat, and (ii) tacking the unfused images onto the receptor sheets.

More particularly, it discloses the use of compacting rollers, which have to fulfil both said functions of thermal isolating and tacking.

As will be clear from the detailed description, it is a remarkable advantage of the present invention that no initial tacking down is necessary and that no compacting rollers are necessary.

It will also become clear from the detailed description, that no intermediate fusing is necessary. Such an intermediate fusing inevitably would increase the construction-cost of the apparatus, and could reduce the reliability of the system, as the dimensional stability of the sheets would diminish because of changing moisture content.

In view of the above, fusing stations of the type described above are unsuitable for being installed in electrographic apparatus designed for single-pass fusing of sheet-fed multi-layer or colour duplex copies.

OBJECTS OF THE INVENTION

It is an object of the present application to provide an apparatus and a method providing good fusing quality for single pass duplex copies of sheet-fed multi-layer copies without intermediate fusing.

Further objects of the present invention will become clear from the description given hereinafter.

SUMMARY OF THE INVENTION

The above mentioned objects are realised by the specific features according to claim 1.

Specific features for preferred embodiments of the invention are set out in the dependent claims.

Further advantages and embodiments of the present invention will become apparent from the following description and drawings.

BRIEF DESCRIPTION OF THE DRAWINGS

The invention will be described hereinafter by way of example with reference to the accompanying drawings.

DETAILED DESCRIPTION OF THE INVENTION

The fusing station according to the present invention will be described hereinafter and illustrated by means of the accompanying figures, which are not intended to restrict the scope of protection applied for by the present application. In the following drawing and description, like referrals (e.g. 1 and 11) constitute like parts (e.g. fixing rollers) with like operation.

Figure 1:
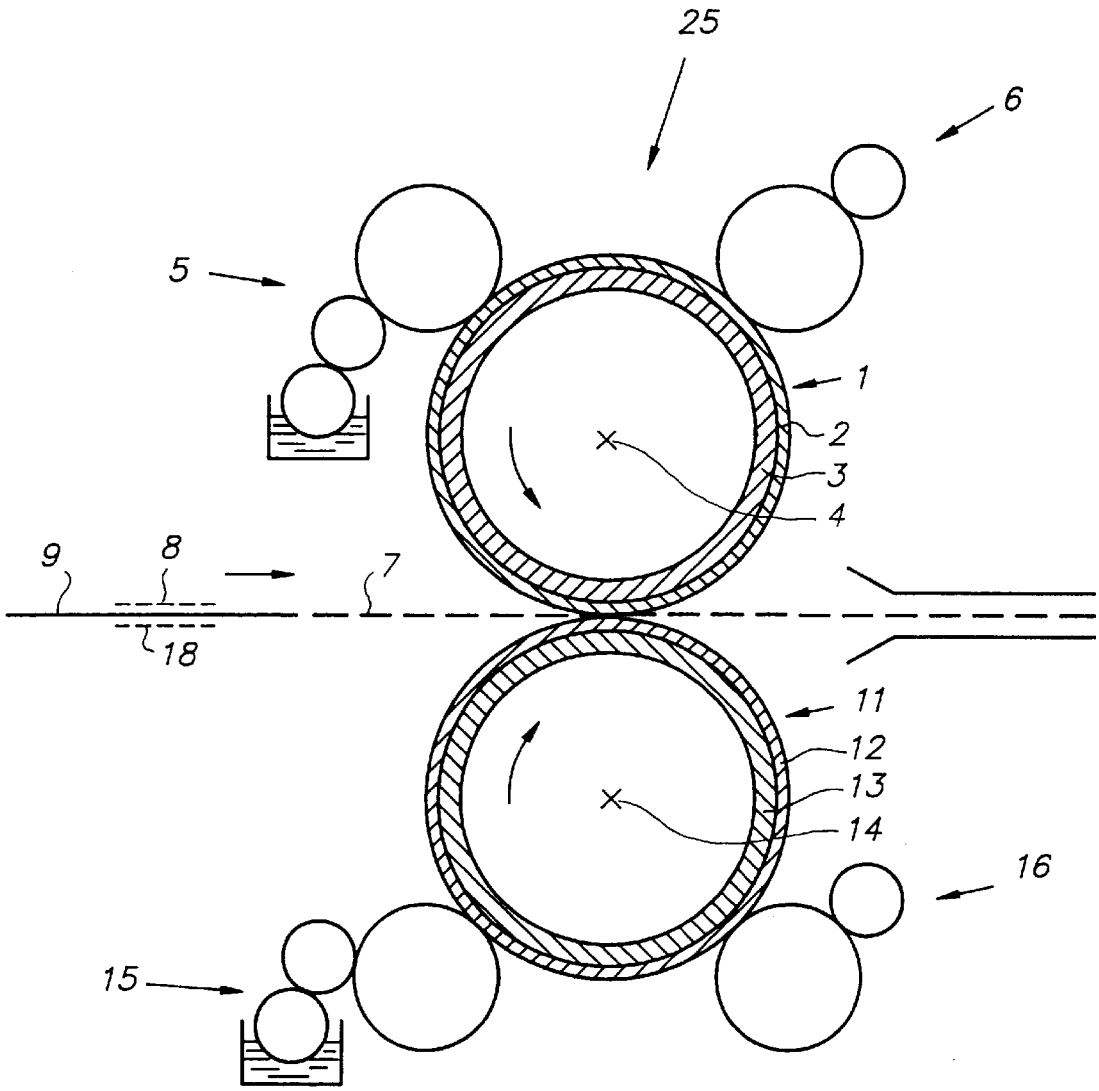
FIG. 1 is a diagrammatic view of a fusing station according to the current invention, comprising a pressure roller pair.

FIG. 1 gives a schematic cross-sectional representation of a fusing station according to the present invention.

As an aid to a better understanding of the specification and the claims to follow, the meaning of some specific terms are explained first.

The terms "support material", "receptor support", "support or substrate member", "receptor sheet" or shortly "sheet" as used further in the present specification stand for a sheet of opaque paper, a white bond paper, a resin coated paper, a transparent film, a plastic, a laminate of both, an adhesive label and the like onto which the transferred image is received. This sheet may be an end-product as such but it may also form an intermediate step in a reproduction process. For example, it may be used, after a suitable treatment, as a so-called transfer element, e.g. as a printing plate for printing images by planographic printing techniques onto a final support. Many experiments carried out by the inventors related to sheets of a so-called "1001 paper", having a specific weight of about 100 g/cm$^2$.

The term "colour" is not strictly limited to the development of usual colour separation images by conventional magenta, cyan and yellow and optionally also black toners (abbreviated as CMY or CMYK). It encompasses also the production of images by means of less or more than three colours; by means of different shades of one colour, e.g. different grey shades, or even multiple layers of one toner; the covering or coating of an image by an image-wise applied transparent, coloured, fluorescent or otherwise treated varnish, and the like.

The term "printing" stands in the first place for a printer which creates an output printing image by laying out the image in a series of horizontal scan lines, each line having a given number of pixels or picture-elements per inch. An exposure station for exposing the recording may comprise a laser with a rotating mirror block, a LED array, a uniform light source and a plurality of individually controllable light valves, an arrangement with deformable micro-mirror devices (DMD), etc. However, the term printing encompasses also an apparatus in which the exposure of the recording member occurs by the optical projection of an integral image, such as in a copier. Further, the term printing also encompasses DEP-devices.

A general overview of an electrographic copying or printing apparatus capable of providing colour images on both sides of sheets of paper is given in pending patent application EP-A-96.203.561.4, entitled "Electrostatic colour printing apparatus" (in the name of Agfa-Gevaert N.V.). In said application, an electrostatographic colour printing apparatus is described which comprises exposure units for forming successive electrostatic colour part images on both surfaces of a recording member in the form of an endless belt. The application addresses developing stations for sequentially developing such electrostatic latent images to form toner images on such belt, and electrostatic transfer stations for sequentially transferring the toner images from such belt in superposition onto a receptor sheet fed through the transfer stations while the receptor sheet is in contact with a belt section to produce a multi-colour duplex image.

FIG. 1 of the instant application shows an embodiment of a heat and pressure fusing device 25, the construction of which is described below. Fusing station 25 comprises a pair of rollers 1, 11. Each roller comprises a solid of revolution made of heat conductive materials 3, 13, e.g. a cylindrical aluminium core or tube. Both heat conductive solids preferably have substantially equal diameters, and are mounted for rotation about their axis by means known in the art. Their peripheral surfaces are provided with a resilient covering 2, 12 of non-adhesive material, e.g. silicone rubber. The resilient covering preferably may be coated with a tetrafluoroethylene resin, a fluorocarbon resin or the like.

Both rollers 1 and 11 may be provided with an internal heating source 4, 14 such as a tubular infrared lamp.

The fusing device comprises means for urging the rollers 1, 11 against each other. As such, a nip is formed with an appropriate length. In our experiments a nip length of about 9 mm was highly preferred. Through the nip a sheet 9 having non-fixed or partially fixed thermoplastic powder or toner images 8, 18 deposited thereon is passed for fixing the toner to the sheet. The urging means may comprise a spring or a pneumatic mechanism (not shown in FIG. 1).

In the vicinity of rollers 1 and 11 there may be provided means 5, 15 for coating an inhibitor solution, release agent, or oil onto the rollers. This prevents toner offset for an easy release of a sheet 9 from the rollers 1, 11. In addition, stripping means (not shown) or the like may be provided for ensuring a reliable release of the sheet from rollers 1, 11.

After having disclosed the basic construction of fusing station 25, now its functional operation will be described. As can be seen in FIG. 1, the sheet 9 bearing toner images 8, 18 on both surfaces is passing through the fusing station 25. The outer surfaces of the fixing rollers, contacting the sheet of support material 9, move with a peripheral velocity synchronous to the speed of advancement of said sheet of support material 9 through the fusing station 25.

As has been put forward hereinbefore, it is important to ensure that no toner particles are offset from the sheet 9 to the rollers 1, 11, and vice versa, neither by friction, neither by adhesion.

Now in order to ensure that no offset due to friction between said sheet of support material 9 and the rollers 1, 11 would occur, said rollers 1, 11 are preferably driven by a suitable motor and suitable belts or gears (not shown) so that the outer surfaces of said rollers 1, 11 advance synchronously to the advancement of the sheet of support material 9 through the fusing station 25. In this way no offset due to friction occurs between said rollers 1, 11 and said sheet of support material 9.

In order to prevent any offsetting of toner from said sheet of support material 9 to rollers 1, 11 due to adhesion of toner particles to said rollers, it is known for those skilled in the art, to cover the roller with a surface layer or resilient covering 2, 12 of a release material such as polytetrafluoroethylene, silicone rubber or the like.

As these materials are heat insulators, the thickness of the layer of these materials on the roller must be kept thin since heat conductance decreases with increased thickness.

It may be repeated here that in a type of fusing station using a pair of heated rollers 1, 11 through which the sheet 9 passes, said heated rollers are preferably covered with a release material or resilient covering 2, 12 and an additional release agent 5, 15 such as silicone oil is preferably used to reduce the offset problem due to the adhesion of toner material to said heated rollers.

In a heated roller pair contact fusing station, intimate contact between the sheet 9 and the heated roller pair 1, 11 is essential for an effective fusing of the toner material 8, 18 on the sheet 9. Indeed, all the heat needed for fusing the toner material has to be passed on to said material through heat conductance from the heated rollers to said toner material. This implies that, during fixing, the toner being fused will be in direct contact with the heated rollers and simultaneously subjected to pressure.

In practice the temperature of the rollers 1, 11 may be kept substantially constant at a predetermined value by introducing a thermistor, e.g. a bimetal within said roller or, more preferably, by a temperature detecting element provided near the surface of the roller, and connecting said thermistor to a thermostatic control circuit (not shown). Even more than one temperature sensor may be used, preferably situated on different positions relative to the roller. For example, one temperature sensor can be in rolling contact with the resilient covering 2, 12 of a fixing roller 1, 11 within the image zone, and another temperature sensor can be in contact with the same fixing roller but outside the image zone.

Also a contactless temperature sensing is highly preferred for measuring the temperature of the surface of the rollers 1 and 11, especially within the image zone.

As the sheet of support material 9 leaves the fusing station 25, it may be taken by an additional pair of rollers (not shown) for further transport to a copy paper tray and for subsequent removal.

In short, a first embodiment of a fusing station 25 according to the present invention is disclosed for use in an electrographic apparatus; comprising as well electrophotographic (comprising an electrical photoconductor), electrophoretic (referring to toner images formed by liquid toner particles), as electrostatic (e.g. DEP-devices) apparatus.

A multi-layer toner image is fused to a support material in sheet-form 9 while said sheet 9 is moved over a predetermined path 7. The fusing station comprises two heated fixing rollers 1 and 11, each for rotating in contact with one side of the sheet. A driving means may be used to rotate the fixing rollers. The outer surface of both rollers is moving synchronously with the speed of advancement of the sheet 9. Pressing means applies an urging force on said fixing rollers 1 and 11. The heating sources 4 and 14 have substantially identical characteristics (geometry, spectrum, power . . . ) and are preferably radiant. Both fixing rollers each have a resilient covering 2 and 12, which by the pressure between both rollers forms a heating nip. As such, a symmetrical fixing operation on both sides 8 and 18 of said sheet is provided by said fixing rollers which preferably have a substantially equal construction and are positioned substantially symmetrically to the path 7 of the sheet.

In a preferred embodiment according to the present invention the thickness t1 of the resilient covering 2 of the first roller 1 is substantially equal to the thickness t2 of the resilient covering 12 of the second roller 2. More particularly, the ratio (t1/t2) of the thicknesses (t1 and t2) of the resilient coverings 2, 12 of the respective fixing rollers, which exemplary are about 2.5 mm, is in a range between 0.9 and 1.1; more preferably between 0.95 and 1.05.

In a further preferred embodiment according to the present invention the ratio (D1/D2) of the diameters (D1 and D2) of the outer circumferences of the respective fixing rollers, which diameters D1 and D2 exemplary are about 73.5 mm, is in a range between 0.9 and 1.1; more preferably between 0.95 and 1.05.

In a further preferred embodiment according to the present invention the nip created between the fixing roller and the pressure roller should have a length larger than 3 mm, preferably larger than 5 mm, and more preferably larger than 7 mm.

In a further preferred embodiment according to the present invention a separate power-control controls each heating source such that the outer circumferences of both fixing rollers have a substantially equal temperature; say e.g. about 443 K (or 170° C.).

In a particularly preferred embodiment, the urging force without sufficient heating is not sufficient to produce fusing, without offset, at said predetermined speed; which may be about 95 mm/s.

A fusing device according to the present invention may comprise means for treating the surface of the fixing roller to release a fixed sheet more easily. Stripping of a fixed sheet may be done by means of release agent, e.g. oil, applied to the fixing roller, but also by means of mechanical or pneumatic systems. A system for fusing a toner image on a sheet then comprises heated fixing rollers exerting a pressure on at least one portion of a toner image on the sheet by a nip formed by pressure between the fixing rollers. Preferably, it further comprises an oil application system for application of oil to the fixing rollers.

More in particular, in a further preferred embodiment according to the present invention, said fusing station further comprises release agent applicators or oiling devices 5 and 15, allocated individually to each fixing roller. These oiling devices have a construction, a position relative to the fixing rollers and an individual oiling control such that the outer circumferences of both fixing rollers receive a substantially equal layer of release agent.

In a further embodiment according to the present invention, said fusing station also comprises cleaning devices 6 and 16, allocated individually to each fixing roller. These cleaning devices preferably have a construction, a position relative to the fixing rollers and an individual drive control such that the outer circumferences of both fixing rollers are cleaned substantially equally.

In a further preferred embodiment, each of said heating sources comprises an infrared or a halogen quartz lamp, mounted individually within each fixing roller.

In still another embodiment according to the present invention, one lamp or a plurality of lamps is mounted within each roller.

In another embodiment according to the present invention, a resistive heater may be used to heat the heat conducting core 3,13.

In a further preferred embodiment of a fusing station according to the present invention, said fixing roller is made of a suitable heat conducting core 3 and 13 and is resiliently covered with a suitable surface layer of a deformable material 2 and 12. More particularly, the outer surface of the fixing roller is covered with a suitable surface layer of a deformable material or resilient covering, which preferably comprises at least (i) an inner layer of a soft or elastically deformable and thermal conductive rubber, and (ii) an outer layer of a release material.

Preferably, said heat conducting core 3 and 13 is made of copper, of aluminium, or an alloy of one of these materials. A thickness of e.g. 4,25 mm has been preferred in the experiments carried out by the inventors.

In a further preferred embodiment of said fusing station, said resilient covering 2 and 12 is silicone rubber or a fluor-elastomer. In the experiments carried out by the inventors a thickness of e.g. 2,5 mm silicone rubber with a hardness of 40 Shore has been preferred.

In a fusing station according to the present invention, a thermal sensor, e.g. a thermistor, is connected to a thermostatic control circuit, the temperature of the roller is kept substantially constant at a predetermined value, said value being set between the temperature at which the resinous toner powder becomes tacky or melts and the fusing temperature of said toner. Preferably, each heating means has an individual power-control for keeping the resilient covering of each roller at a substantially equal temperature, the temperature deviation between said rollers being less than 20 K, preferably less than 5 K.

In a fusing station according to a further preferred embodiment the outer surface of the resilient covering 2 and 12 of the fixer rollers advances synchronously with the advancement of the sheet 9 through the fusing station 25 and at least one of the devices e.g. sensor, cleaning, release agent applicator which are in contact with the fixing rollers 1 and 11, have a synchronously rolling contact.

It is further highly preferable that in a fusing station 25 according to the present invention, said path 7 of the sheet, at least between the transfer station and the nip, is substantially rectilinear. Between a transfer station and the nip of the rollers of the fusing station, a radius of curvature of said path preferably is larger than two times the outside diameter of the rollers, more preferably larger than five times.

In order to obtain a good and equal thermal behaviour of both fixing rollers, they preferably comprise substantially the same materials as well for the core 3, 13 as for the resilient covering 2, 12, in substantially same thicknesses, etc. Further, said fixing rollers preferably are mounted with their longitudinal axes in parallel. Generally, both fixing rollers have a same geometry, mostly being cylindrical. Nevertheless, convex and/or concave geometries of the fixing rollers (e.g. in order to prevent possible wrinkling of the sheets) also fall within the scope of the present invention.

Apart from a physical fusing station as disclosed before, also a method is disclosed for single pass fixing of duplex or recto/verso copies comprising toner images 8 and 18 on both sides of a sheet 9 using a fusing station 25 as described above.

In a further preferred embodiment of a method according to the present invention, toner image 8 and 18 is a multi-layer image composed of superimposed colour separation images.

In a particular method according to the present invention, the path 7 of the sheet 9 of support material is substantially horizontal. By the wording substantially horizontal is meant a path within a range of [−5°, +5°] to a horizontal path.

In another particular method according to the present invention, the path 7 of the sheet 9 of support material is substantially vertical. By the wording substantially vertical is meant a path within a range of [−5°, +5°] to a vertical path.

Some advantages of a horizontal path comprise:

(i) if the sheets in an input paper tray and in an output paper tray lay in a horizontal position, said sheet can follow a rectilinear path, which is very advantageous for a high reliability of the transport system (e.g. a very low risk for paper jam and for wrinkles);

(ii) the height of the apparatus can be rather low, which may be extra comfortable for the operator.

Some advantages of a vertical path comprise:

(i) the operations acting on the sheet may be carried out with a high symmetry, because there is no preferential influence from heat or gravity as it regards both sides of the sheet;

(ii) the floor-space necessitated for the apparatus can be rather small.

Yet any other orientation of the path 7 of the sheet 9 may be advantageous and is included within the scope of the present invention.

A further preferred method comprises a preheating step, acting symmetrically on both sides 8 and 18 of the blank sheets 9, thus before said sheets receive any toner particles. By doing so, some mechanical characteristics of the sheets (e.g. moisture contents or differences thereto) may be equalized, so that possibly a still lower jam rate and even a better fusing quality can be attained.

As will be clear from the background section of this specification, single pass duplex multi-layer toner fusing on sheets nowadays presents some other difficulties to be solved.

Amongst them:

(i) transporting the duplex powdered sheets from the duplex imaging device towards the single pass duplex fuser without damaging the non-fixed images;

(ii) providing a specific fusing speed required to obtain stable image quality on a wide variety of base print materials, whereas the imaging portion of the engine usually only has a very limited number of discrete imaging speeds;

(iii) moreover, the fusing and imaging speed can hardly be made exactly equal, thereby necessitating a way to decouple both speeds.

In a method according to the present invention, these just mentioned difficulties are solved by providing a buffering device between imaging station or transfer station and fusing station. This buffer can handle differences in speed, vibrations, etc.

The purposes of the just mentioned buffer may be explained more in detail as follows. Fuser station 25 melts the toner images 8, 18 transferred to the sheets 9 in order to affix them. It will be understood that this operation requires a certain minimum time, since the temperature of the fuser is subject to an upper limit which must not be exceeded. Otherwise the roller lifetime becomes unsatisfactory. In other words, the speed of fuser station 25 is limited. The speed of the image formation stations (not shown), on the other hand, is in principle not limited for any particular reason. On the contrary, it is advantageous to use a high speed of image formation and image transfer, since the (e.g. four) colour separations of each colour image are preferably written by an exposure station in succession. This means that the recording time of one colour image amounts to at least four times the recording time of one part image. All this means a relatively high speed of the photoconductive belts, and thus of the synchronously moving sheets, as compared with a maximum usable travelling speed through the fuser station. In order to indicate some practical test-results, in an apparatus according to the present invention, the speed of the photoconductive belts amounted to 295 $mm.s^{-1}$, whereas the fusing speed was 100 $mm.s^{-1}$.

Further, it may be desirable to adjust the fusing speed independently from the image processing speed, for obtaining optimum results. It should be noted that the image processing speed in the imaging stations is preferably constant.

The length of the buffer station needs to be sufficient large for receiving the largest sheet size to be processed in the apparatus.

Whereas the buffer station operates initially at the speed of the photoconductive belts, the speed of this buffer station is reduced to the processing speed of fuser station 25 as the trailing edge of the sheet has left the image forming station.

As disclosed in European Patent Application n° 96.200.977.5 (in the name of Agfa-Gevaert N.V.), in a colour toner image, the amount and/or the dispersion of pigment in the toner particles, for a single colour, is preferably adjusted such that a full saturated density in said colour is achieved by the deposition of a thin, almost single, layer of toner particles. By doing so the gloss differences, due to (possibly great) differences in the height of the various layers of deposited toner particles, are minimized.

In a preferred embodiment, the amount of toner particles per unit area (Toner Mass, TM) being deposited to reach maximum optical density for each of the single colours follows the equation:

$$TM \leqq 0.8 \times d_{v50} \times \rho \qquad [1]$$

wherein TM is expressed in $mg/cm^2$, $d_{v50}$ is the average volume diameter of the toner particles expressed in cm), and $\rho$ is the bulk density of the toner particles in $g/cm^3$ (e.g. $\rho$=1.1 to 1.3 $g/cm^3$).

In this application by maximum optical density for each of the single colours is meant an optical density on a reflecting support between 1.4 and 1.6 for yellow, magenta and cyan and an optical density between 1.6 and 2.0 for black.

Thus, in the production of full-colour images, e.g. with four colour toners YMCK, each of the toners having a $d_{v50}=8.10^{-4}$ cm and a density of 1.25 $g/cm^3$, the very darkly coloured areas will be formed by the overlay of about 2,5 layers, each being made up by 0.8 $mg/cm^2$ of toner. Fixing of a resulting toner layer of about 2,5 $mg/cm^2$ is quite difficult and requires special measures.

Now, we just have disclosed an apparatus and a method for single pass fixing of a multi-layer toner image toner image to a sheet of support material. Also disclosed was a method particularly suitable for fixing duplex copies.

In a further embodiment of a method according to the present invention, the amount of toner particles TM being deposited to reach maximum optical density for black (i.e. an optical density between 1.6 and 2.0 on a reflecting support) follows the equation $$TM \leqq 0.8 \times d_{v50} \times \rho \qquad [1]$$

wherein TM is expressed in $mg/cm^2$, $d_{v50}$ is the average volume diameter of the toner particles expressed in cm, and $\rho$ is the bulk density of the toner particles in $g/cm^3$.

In another preferred embodiment of a method according to the present invention, the amount of toner particles TM being deposited to reach maximum optical density for each of the single colours yellow, magenta, cyan (i.e. an optical density between 1.4 and 1.6 on a reflecting support) also follows the same equation $$TM \leqq 0.8 \times d_{v50} \times \rho \qquad [1]$$

wherein TM is expressed in $mg/cm^2$, $d_{v50}$ is the average volume diameter of the toner particles expressed in cm, and $\rho$ is the bulk density of the toner particles in $g/cm^3$.

In case the image is developed by means of a colourless toner as exemplified in, e.g., EP-A 0 656 129, EP-A 0 629 921, EP-A 0 486 235, U.S. Pat. No. 5,234,783, U.S. Pat. No. 4,828,950, EP-A 0 554 981, WO 93/07541 and Xerox Research Disclosure Journal, Vol.16, N° 1, p. 69 (January/February 1991), this colourless toner is preferably deposited in an amount TM fulfilling the equation [1]. Also in this case, the present invention remains applicable.

APPLICABILITY

A contact heat and pressure fixing according to the present invention is more advantageous than fixing by utilising irradiated heat in that it needs less electric power, and in that the danger of fire hazard and burning of the sheets is much lower.

It is a remarkable further advantage of the present invention to obtain an equal quality on both image-sides, even when some characteristics of the system might be different, e.g. different roughness on the recto versus the verso side of the sheets, different construction or position of the release agent applicators, thermal influences differing on both fixing rollers, etc.

For the purposes of the present invention the latent electrostatic image may be formed by an exposure of an electrostatically charged photosensitive member to a light image of an original document. Or, the latent electrostatic image may be generated by exposing the photosensitive member to a plurality of appropriately activated discrete spot-like sources of radiation. Said discrete spot-like sources of radiation may be constituted by a linear array of light emitting diodes (LED's) or by a laser, the beam of which is modulated to determine during each scan movement a plurality of elementary image sites that may receive radiation or not depending on the modulation of the radiation beam.

Evidently, a method for single pass fixing of simplex copies (comprising toner images on one side of a sheet) using a fusing station 25 according to the present invention, also falls within the scope of protection.

The present invention also may be used in a method for producing double simplex copies or prints by means of a single pass duplex copier or printer.

Said method is characterised by the steps of (i) using for a copying or printing cycle two receptor sheets and conveying them back to back in coinciding relationship along a common path through said printer, (ii) forming one toner image on one side of one receptor sheet and another toner image on the opposite side of the other one while both receptor sheets are simultaneously moved through the printer thereby to produce two simplex prints, and (iii) fixing the toner images on both sheets. For more specific information, reference is made to patent application EP-A-96.203.558.0 (in the name of Agfa-Gevaert N.V.).

In a preferred embodiment it is desirable to provide a single pass duplex system having a discrete receptor sheet feed system. Optionally also a web paper feed system may be used with the concept of a symmetrical fixing operation as laid down in the present application.

Apart from traditional toner images formed by dry toner particles, the present invention also may be carried out on toner images formed by liquid toner particles, e.g. applied by electrophoretics.

As also mentioned in the introduction of this specification, the use of a fixing device according to the present invention is particularly interesting for the fusing of electrographic multi-layer images, e.g. electrophotographic colour images, even for simplex or single-sided copies.

However, its use is still more interesting in the fusing of duplex colour images since the problem of surface temperature fluctuations of fixing rollers is even more stringent in such application. In this connection, we refer to our above mentioned co-pending EP-A-96.203.561.4.

It may be clear for people skilled in the art, that the previously mentioned buffering device between imaging and fusing can be used advantageously also in other types of fusing stations, as e.g. in fusing stations using directly radiating radiators (thus not being built in rollers) as short-wave (e.g. infrared lamps), mid-wave or long-wave radiators (e.g. resistive or ceramic elements) or flash lamps, in fusing stations using electromagnetic waves (e.g. micro-waves), in fusing stations using hot air, etc.

In an alternative embodiment according to the present invention, the symmetrical fixing operation can also be realised by using a hot air fusing station. Herein the fusing is done nearly contactless (meaning that substantially no rollers nor plates are in contact with the sheets while being fixed) and a controlled stream of hot air is conveyed symmetrically at both sides of the sheet. Evidently, flow and temperature of said hot air have to be controlled within acceptable limits.

Such a fusing method comprises a step of moving the sheet, which may be carried out by different mechanisms. For example: gravity as such in case of a vertical path, downwards oriented, of the sheet, a belt, a clamp mechanism gripping the sheet on non-imaged borders, or another transporting means comprises means for keeping a fixed orientation of the sheet and means for keeping contact with an edge of the sheet, etc.

Figure 2:
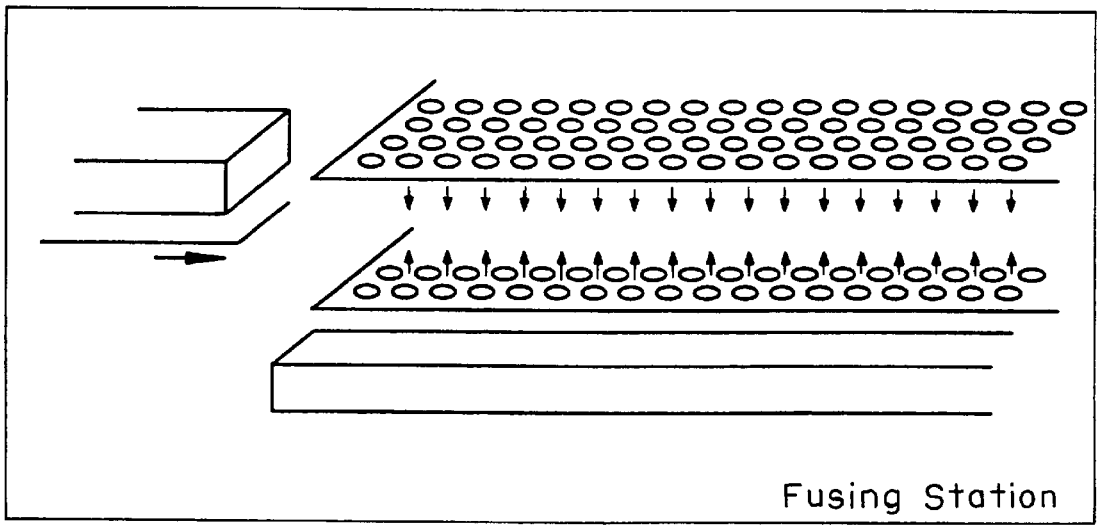
FIG. 2 is a diagrammatic view of another fusing station according to the current invention, comprising a flow of hot air.

Such a fusing method also comprises a simultaneous step of sheet heating, while moving said sheet, by symmetrically applying hot air, which may be carried out by different mechanisms. For example: by a set of two perforated plates, localised at both sides of the sheet on the path followed by the sheet(see e.g. FIG. 2).

Said hot air fulfils two different functions:

(i) an air-cushion function which helps the contactless moving of the sheet, (ii) a fusing function by symmetrically and homogeneously heating both sides of the sheet.

In short, a further preferred embodiment of a method for single pass fixing of duplex or recto/verso copies of resinous powder colour images to a support material, comprises the simultaneous steps of (i) moving said sheet via a predetermined path through a fusing station, (ii) applying hot air in said fusing station to both sides of said sheet, wherein said fusing station comprises heating sources with substantially identical operational characteristics, and wherein said application of hot air is characterised in that a symmetrical fixing operation on both sides of said sheet is provided by heating said hot air to a substantially equal temperature and by enforcing said hot air in a substantially equal flow to both sides of said sheet. It may be remarked that this embodiment also can be applied to receptor support materials which are not separate sheets in the strict meaning, but which are in web-form.

Various modifications will become apparent to those skilled in the art based on the teachings of the present disclosure, without departing from the scope thereof.

Among these modifications, sheets fed from the input-stack (not shown in FIG. 1) can occasionally be subjected to a drying operation prior to the toner image transfer, in order to get a sufficiently low moisture content, e.g. below 60%.

Another modification also protected by the present application, comprises a preheating step acting on the blank sheets prior to the fusing step, even prior to the transfer step or even prior to the development step. Although such a preheating increases the construction-cost of the apparatus, the operation-cost of the apparatus decreases; as the fixing energy in the fixing step decreases, the change of moisture in the sheets decreases, the possible jam rate decreases.

| Parts list | |
|---|---|
| 1, 11 | (fixing) rollers |
| 2, 12 | resilient covering |
| 3, 13 | heat conducting core |
| 4, 14 | heating sources |
| 5, 15 | release agent applicator (oiling devices) |
| 6, 16 | cleaning devices |
| 7, 17 | path |
| 8, 18 | toner material |
| 9 | sheet(s) |
| 25 | fusing station |

We claim:

1. A fusing station for fixing multi-layer toner images on opposite sides of a support material comprising first and second rollers forming a pressure roller pair having a nip larger than 7 mm, the first and second roller each making contact with toner images of one side of said support material;

the first and second rollers each having:

a resilient covering for making contact at the nip with the toner image on one side of said support material, and means for heating the resilient covering of said roller, wherein said first and second rollers have outer diameters which are substantially equal, and wherein the thickness of the resilient covering of the first roller is substantially equal to the thickness of the resilient covering of the second roller, the heating means of each roller having an individual power-control for keeping the resilient covering of each roller at a substantially constant temperature, with the temperature deviation between said rollers being less than 20 K.

2. The fusing station according to claim 1, wherein the ratio (D1, D2) of the respective outer diameters (D1, D2) of the first and second rollers is between 0.9 and 1.1.

3. The fusing station according to claim 1, wherein said resilient covering of each roller has a thickness larger than 1.5 mm, preferably.

4. The fusing station according to claim 1, wherein each of said rollers is coupled to a release agent applicator.

5. The fusing station according to claim 1, wherein each of said rollers is coupled to a cleaning device.

6. The fusing station according to claim 1, wherein the resilient covering of each roller is arranged for an advancement with a peripheral speed synchronous to the advancement of the support material through the fusing station.

7. The fusing station according to claim 1, wherein at least one device which is in contact with a roller has a peripheral speed synchronous to the advancement of the support material through the fusing station, preferably with a mutual speed deviation less than 10%, more preferably with a speed deviation less than 2%.

8. The fusing station according to claim 1, wherein said multi-layer toner image (8, 18) has dry toner particles.

9. The fusing station according to claim 1, arranged for movement of said support material along a path between a toner transfer station and the entrance of said fusing station, wherein said path is substantially rectilinear.

10. A method for single pass fixing a duplex copy, said copy having a toner image on both sides of a support material, using a fusing station according to claim 1.

11. The method according to claim 10, wherein said toner image is a multi-colour image composed of superimposed colour separation images.

12. The method according to claim 10, further comprising the step of preheating, acting substantially symmetrically on both sides of the support material.

13. A method for fixing of double simplex copies in an electrographic apparatus using a fusing station according to claim 1, characterised by the steps of (i) using for a printing cycle two receptor sheets and conveying them back to back in coinciding relationship along a common path through said apparatus, (ii) forming one toner image on one side of one receptor sheet and a toner image on the opposite side of the other sheet while moving both receptor sheets simultaneously through the apparatus thereby to produce two simplex prints, and (iii) fixing the toner images on both sheets.

14. The method according to claims 10 or 13, wherein the amount of toner particles TM being deposited to reach maximum optical density for black follows the equation $$TM \leqq 0.8 \times d_{v50} \times \rho \qquad [1]$$

wherein TM is expressed in mg/cm$^2$, $d_{v50}$ is the average volume diameter of the toner particles expressed in cm, and $\rho$ is the bulk density of the toner particles in g/cm$^3$.

15. The method according to claims 11 or 13, wherein the amount of toner particles TM being deposited to reach maximum optical density for each of the single colours yellow, magenta, cyan follows the equation $$TM \leqq 0.8 \times d_{v50} \times \rho \qquad [1]$$

wherein TM is expressed in mg/cm$^2$, $d_{v50}$ is the average volume diameter of the toner particles expressed in cm, and $\rho$ is the bulk density of the toner particles in g/cm$^3$.

16. The fusing station according to claim 1 further comprising a preheater, said preheater substantially symmetrically heating both sides of the support material prior to entry into the nip.

* * * * *

UNITED STATES PATENT AND TRADEMARK OFFICE

CERTIFICATE OF CORRECTION

PATENT NO. : 6,002,894
DATED : December 14, 1999
INVENTOR(S) : De Niel et al.

It is certified that error appears in the above-identified patent and that said Letters Patent is hereby corrected as shown below:

Title page,
Item [56], References Cited, FOREIGN PATENT DOCUMENTS, insert -- 3177874 Japan --;
Item [73], Assignee, "Germany" should read -- Belgium --;

Column 15,
Line 7, "(D1, D2)" should be deleted;

Signed and Sealed this

Seventh Day of May, 2002

*Attest:*

*Attesting Officer*

JAMES E. ROGAN
*Director of the United States Patent and Trademark Office*